US005927563A

United States Patent [19]

Kellner

[11] Patent Number: 5,927,563

[45] Date of Patent: Jul. 27, 1999

[54] VALVE ARRANGEMENT FOR A PRESSURIZED LIQUID OR FOAM DISPENSER

[75] Inventor: Klaus Kellner, Kammerstein, Germany

[73] Assignee: Firma AMV Automation Montage Vertrieb, Windsbach, Germany

[21] Appl. No.: 08/849,493

[22] PCT Filed: Oct. 20, 1995

[86] PCT No.: PCT/DE95/01460

§ 371 Date: Oct. 3, 1997

§ 102(e) Date: Oct. 3, 1997

[87] PCT Pub. No.: WO96/17795

PCT Pub. Date: Jun. 13, 1996

[30] Foreign Application Priority Data

Dec. 6, 1994 [DE] Germany ..... 44 43 287

[51] Int. Cl.[6] ..... B65D 83/00

[52] U.S. Cl. ..... 222/402.22; 222/402.21; 222/402.1

[58] Field of Search ..... 222/402.1, 402.21, 222/402.22

[56] References Cited

U.S. PATENT DOCUMENTS 4,165,825 8/1979 Hansen ..... 222/402.22

4,651,899 3/1987 Pauls et al. ..... 222/130

4,805,813 2/1989 Metcoff et al. ..... 222/402.22

4,824,075 4/1989 Holzboog ..... 251/349

*Primary Examiner*—Andres Kashnikow

*Assistant Examiner*—David Deal

*Attorney, Agent, or Firm*—Robin, Blecker & Daley

[57] ABSTRACT

The invention relates to a valve arrangement for a container used to dispense pressurized liquid or foam, especially PU foam such as assembly or sealing foam from a container, the top of the said container being provided with a valve disk (13), which has an opening, especially of a circular shape, in which a valve body (1) equipped with a valve stem (4) is fixed. The valve stem (4) is depressible against an elastic restoring force, and thus cooperates with sealing elements in the manner of a valve opening. The sealing elements are provided on the sealing member with sealing faces, especially of a planar or conical shape, and in a closed position bear on the sealing faces of the valve body (1) disposed in plane or conical manner, the valve body (1) being a plastic sandwich structure consisting of an inner hard part (2) and an outer soft part (3). The inner hard part (2) and the outer soft part (3) are intimately joined together over their common contact surfaces by an injection-molding process to form a perfect bond.

30 Claims, 9 Drawing Sheets

VALVE ARRANGEMENT FOR A PRESSURIZED LIQUID OR FOAM DISPENSER

The invention relates to a valve arrangement having the features of the preamble of claim 1. Such valve arrangements are mounted on a container used to dispense pressurized liquid or foam, especially PU foam, assembly foam or sealing foam, the top of the said container being provided with a valve disk, which has an opening, especially of a circular shape, in which a valve body equipped with a valve stem is fixed. The valve stem is elastically depressible, and thus cooperates with sealing elements in the manner of a valve opening. The sealing elements are provided with sealing faces, especially of a planar or conical shape, which faces are disposed on a sealing member and in a closed position bear on correspondingly shaped sealing faces of the valve body.

Known valve arrangements have elastic sections or elements that ensure depressibility of the valve stem. These elastically constructed sections or elements, which can have a domed shape, for example, tend to exhibit instabilities that may lead to impairment of function during storage and operation. Available valve bodies often lack the necessary elastic characteristics or no longer have such characteristics to begin with or after being used for only a short time. They are either too hard or not sufficiently flexible, or they may be too soft or wear too quickly. This means that the valve arrangement does not return to the specified initial or closed position after the discharge process and no longer achieves adequate sealing. Foam leaks out, and this may lead to contamination and damage under some circumstances.

The object of the invention is to improve and construct a valve arrangement in such a way that it has high functionality in combination with a simple design, ensures a good sealing effect and is easy to manufacture and assemble. This object is achieved by the characterizing features of claim 1. Advantageous further embodiments of the invention are presented in dependent claims 2 to 30.

The central idea of the invention is to construct the valve body as a plastic sandwich structure consisting of an inner hard part and an outer soft part, the inner hard part and the outer soft part being intimately joined together over their common contact surfaces by an injection-molding process to form a perfect bond. The elastic part attached to on the valve body is also made as a two-component structure in this way, thus assuring the required permanent and robust elastic characteristics that are necessary for good leak-tightness of the valve system. The valve body is made by a two-stage injection-molding process. The outer soft part ensures the necessary elastic action in the depressible region, and also ensures the necessary sealing effect in the regions at the sealing member, the valve disk and the connection for the outlet line. The inner hard part is formed substantially as a pipe-shaped member, which as a component of the valve body passes completely or partly therethrough and thus reinforces the valve body in selected regions, including the elastic region.

In the two-stage injection-molding process, the contact surface of the hard material adheres very intimately to the available contact surface of the soft material, and so a body with inseparable sandwich structure is obtained. An advantage of this embodiment is that the outer soft part of the valve body in cooperation with the inner hard part provides an excellent sealing effect after the discharge process and during storage. Additional O-rings and similar components as used in prior-art valve arrangements are not necessary.

One and the same soft body is also used f?r other sealing regions, however, specifically in the top end region thereof by providing valve-stem sealing lips as a connection for the outlet lines, to which a discharge device such as a spray gun or similar device can be attached, and as the seal between the valve disk and valve body. By virtue of the multiple sealing function, savings are achieved both in material and assembly costs for manufacture of the complete arrangement.

It may be advantageous for the inner hard part of the valve body to be provided in the middle region of the inner hard part with an outwardly directed annular shoulder, which projects radially beyond the pipe-shaped section of the hard part.

The sealing member is advantageously fixed to the bottom open end of the inner hard part, for which purpose a holding element in the form of a bayonet fastener or snap hook that engages in the bottom open end of the inner hard part can be disposed, for example, at the top end of the sealing member. It is also possible, however, to form the joint between the sealing member and the bottom end of the hard part by a press-fit joint, a cemented joint or an ultrasonically bonded joint.

It is particularly advantageous, in the case of the domed shape of the flexible region, for the outwardly directed annular shoulder to be continued in the manner of a convexly arched dome of the relatively hard material, covered on the outside of the hard dome by a dome of the soft part. Thereby the soft material is supported by the relatively hard material, and so large elastic restoring forces that ensure excellent sealing are produced.

The bottom region of the dome is continued in the manner of a cylindrical wall, which is surrounded by a region of larger material thickness of the soft part, in which the valve disk is anchored by injection molding.

The valve disk can have various forms. For example, it may even be drawn into the shape of a pot and additionally provided with a threaded spray part mounted therein. The threaded spray part is fixed in the injection-molding mold before the valve disk is positioned and is permanently secured against twisting by impressions, beads or the like in the valve disk.

If the valve disk with the radially outside rim of the disk bent over in the form of a U is provided with a radially outward projection, a discharge-gun adapter can be mounted directly on the valve disk.

The projection may be a circumferential or at least partly circumferential beading around the rim and may form an element of a bayonet fastener, to be locked by turning, between the valve disk and the discharge-gun adapter. It is equally possible to provide the discharge-gun adapter with outwardly elastic latching hooks, which engage elastically over the projection or the beading to create a latching snap connection. Alternatively, it is also possible to construct the projection as an external thread and to provide the discharge-gun adapter with an internal thread fitting on the external thread.

A further particularly advantageous modification of the valve disk is clear from claim 25, according to which the valve disk is drawn in the form of a pot into the region of the sealing member and provided in the region of the sealing member with inwardly pointing holding projections. An elastic member that bears on the sealing member in a closing direction can be suspended in these holding projections. By virtue of these provisions, the closing force of the sealing member is reinforced by an additional elastic member, an action that takes place independently of the development of any other elasticity of the valve body. In this case it should be advantageous to construct the elastic member as a metal body stamped in the form of a pot. The bottom region of the metal body is provided with a punched-out tongue that projects toward the sealing member and bears elastically thereon.

The features of claims 29 and 30 ensure a well-defined transmission of force into the sealing member as well as an elastic transfer of force to the outer rim of the sealing member.

The invention will be explained in more detail by reference to practical examples in the figures of the drawings, wherein.

Figure 1:
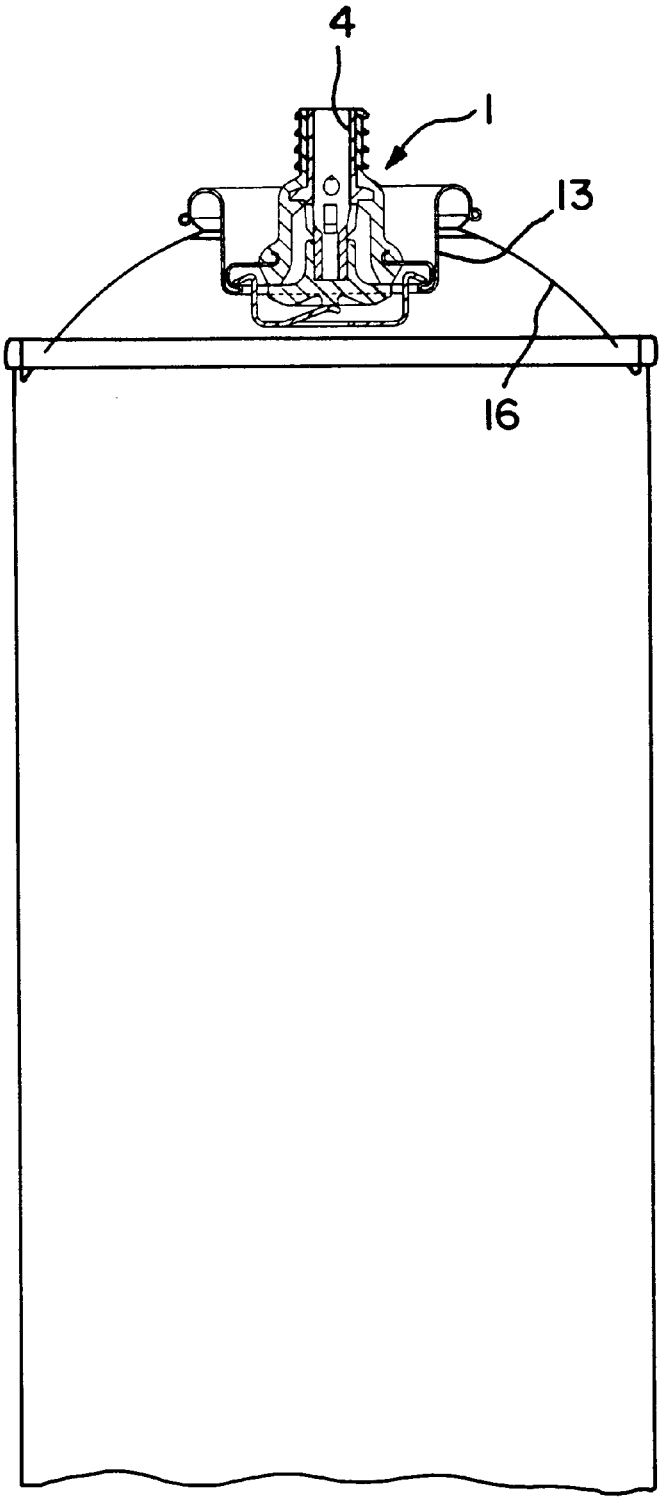
FIG. 1 shows a first practical example of a valve arrangement mounted on a foam canister.

FIG. 1 will be considered first. This figure illustrates how a valve arrangement is mounted in a valve disk 13 of a foam canister. The valve arrangement is seated in the valve disk 13, which is drawn in the shape of a pot and which holds the valve arrangement in the inner region of the disk.

Figure 2:
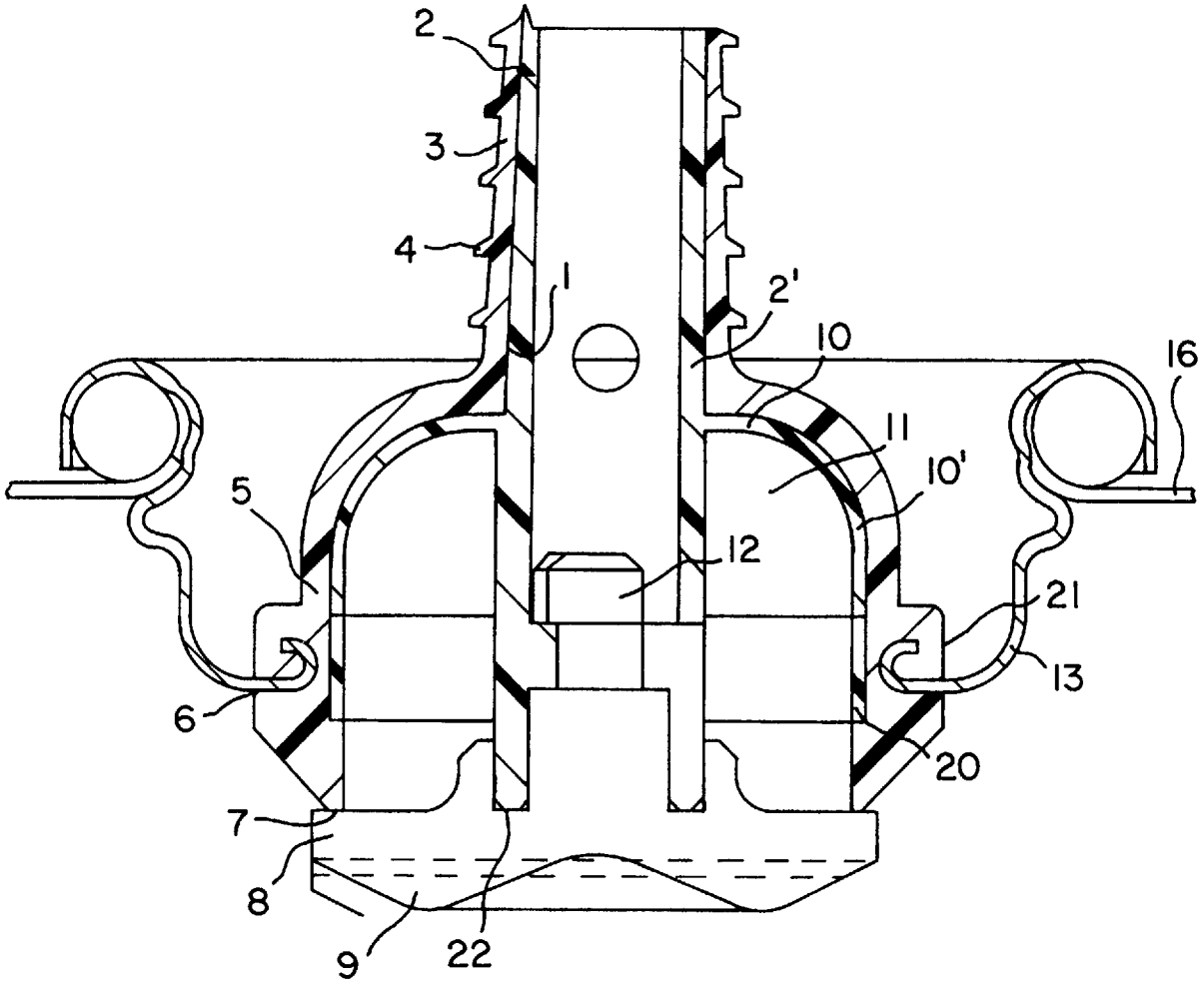
FIG. 2 shows a modified valve arrangement, in which the depressible, flexible region of the valve body is dome-shaped and the valve stem protruding from the container is provided with soft sealing lips disposed with spaces between them.

Details of a valve body are clear from FIG. 2. The valve body 1 has a flexible, dome-shaped region 5 with a contiguous connecting and sealing region 6, which is joined radially externally to the valve disk 13, which in turn is joined to the container inner wall 16 of the spray canister, the said sealing region 6 passing through the opening to the container inside space and merging into a wall section with the plane sealing face 7. This soft sealing face 7 cooperates with a separate, hard sealing member 9, which is held in the inside of the dome-shaped region 5 by a bayonet fastener 12.

When the valve arrangement is actuated, i.e., by depressing the flexible, dome-shaped region 5, the liquid or foam emerges through a valve opening 8 that is then released. The further outlet path leads via a space 11 formed between the valve body and sealing member and from there via an inner hard part 2 of the valve body 1 to the outlet line or to a spray gun.

By virtue of the soft sealing face 7 of the outer soft part 3 of the valve body 1, an additional O-ring or similar part is not necessary.

In the upper region of the valve body 1, the inner hard part 2 together with the outer soft part 3 forms a valve stem 4 with soft sealing lips for attachment of an outlet line or a spray gun.

From FIG. 2 it is also clear that the valve disk 13 is joined to the container inner wall 16 by means of a clinched arrangement.

Figure 3:
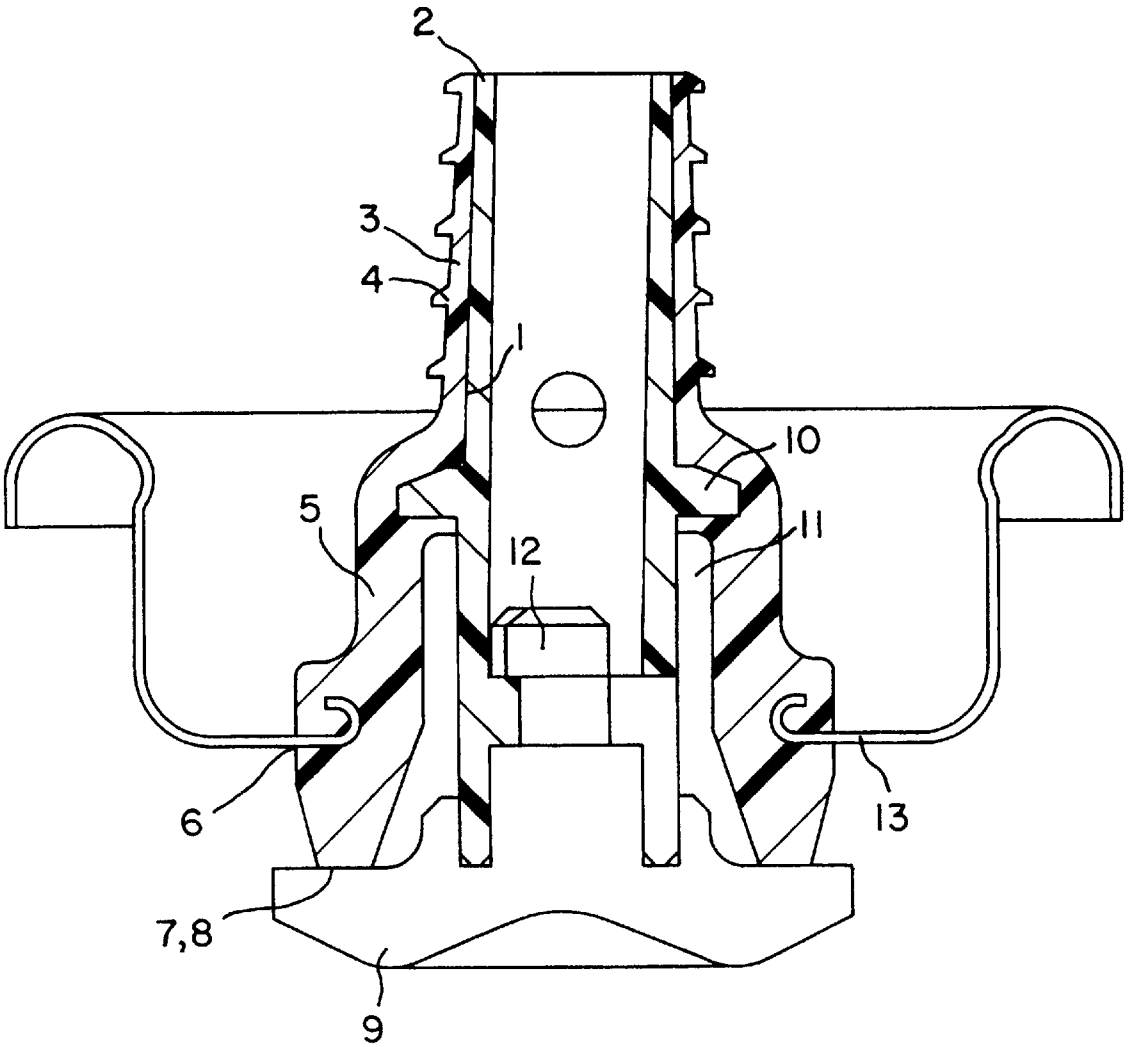
FIG. 3 shows a modified valve arrangement in which the depressible, flexible region of the valve body is formed such that the space filled with material to be discharged and disposed between valve body and sealing member is of a small volume.

FIG. 3 illustrates another advantageous embodiment of the invention characterized in particular by the depressible, flexible region 5, which in this case forms a space 11 of small volume. The outlet path of the liquid or foam is thereby shorter and more advantageous, and the material to be discharged cannot solidify as readily as in the embodiment with a dome-shaped region. In addition to the parts with the reference numbers already listed in the description of FIG. 2, the embodiment according to FIG. 3 has an outwardly directed annular shoulder 10 on the inner hard part of the valve body 2. The annular shoulder 10 improves the intimate bond between the inner hard part 2 and the outer soft part 3 of the valve body.

Figure 4:
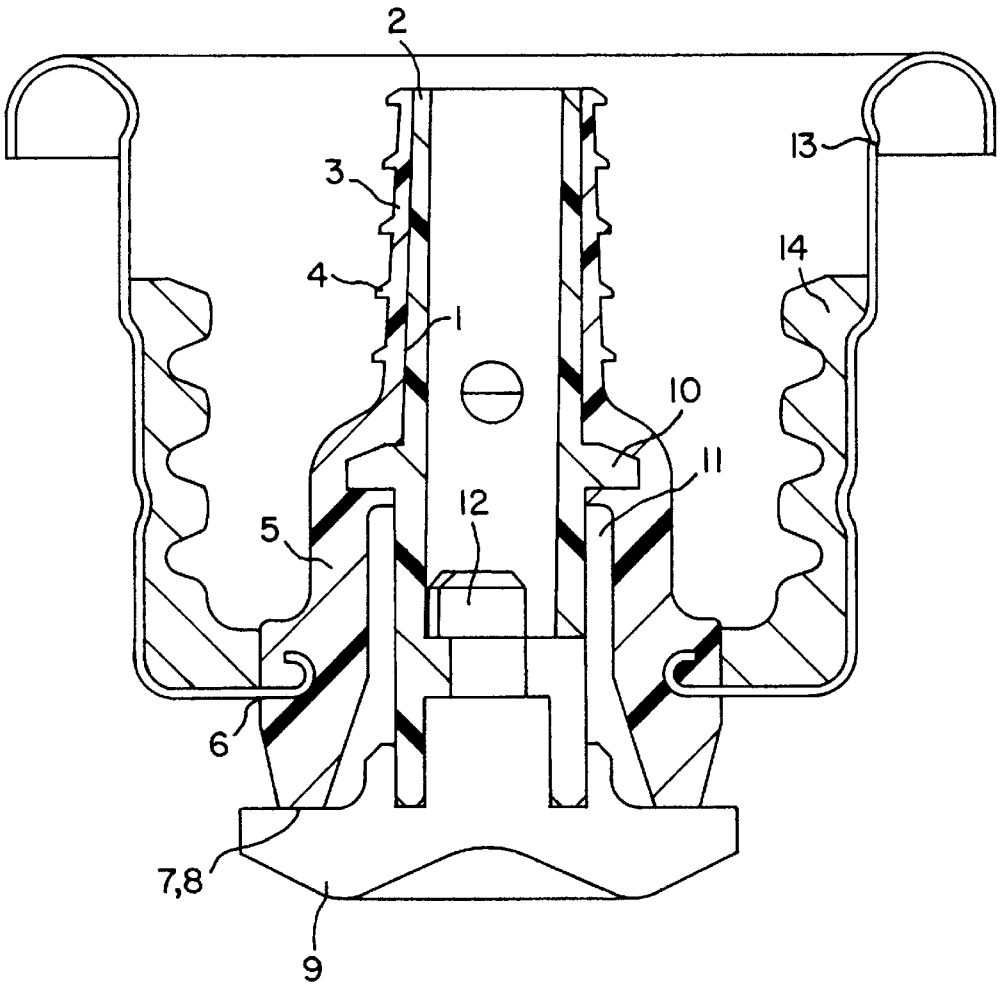
FIG. 4 shows a further modified valve arrangement, in which the valve disk is deep-drawn in the form of a pot and in addition is provided with a threaded spray part mounted therein for screwing in outlet elements.

FIG. 4 shows a further advantageous embodiment characterized in particular by a deep-drawn valve disk 13 with a threaded spray part with internal thread 14 mounted therein. The discharge elements or the spray gun can be screwed into this threaded spray part. In contrast to the parts with the reference numbers already listed in the description of FIG. 3, the valve stem 4 with the soft sealing lips does not protrude from the container in FIG. 4.

Figure 5:
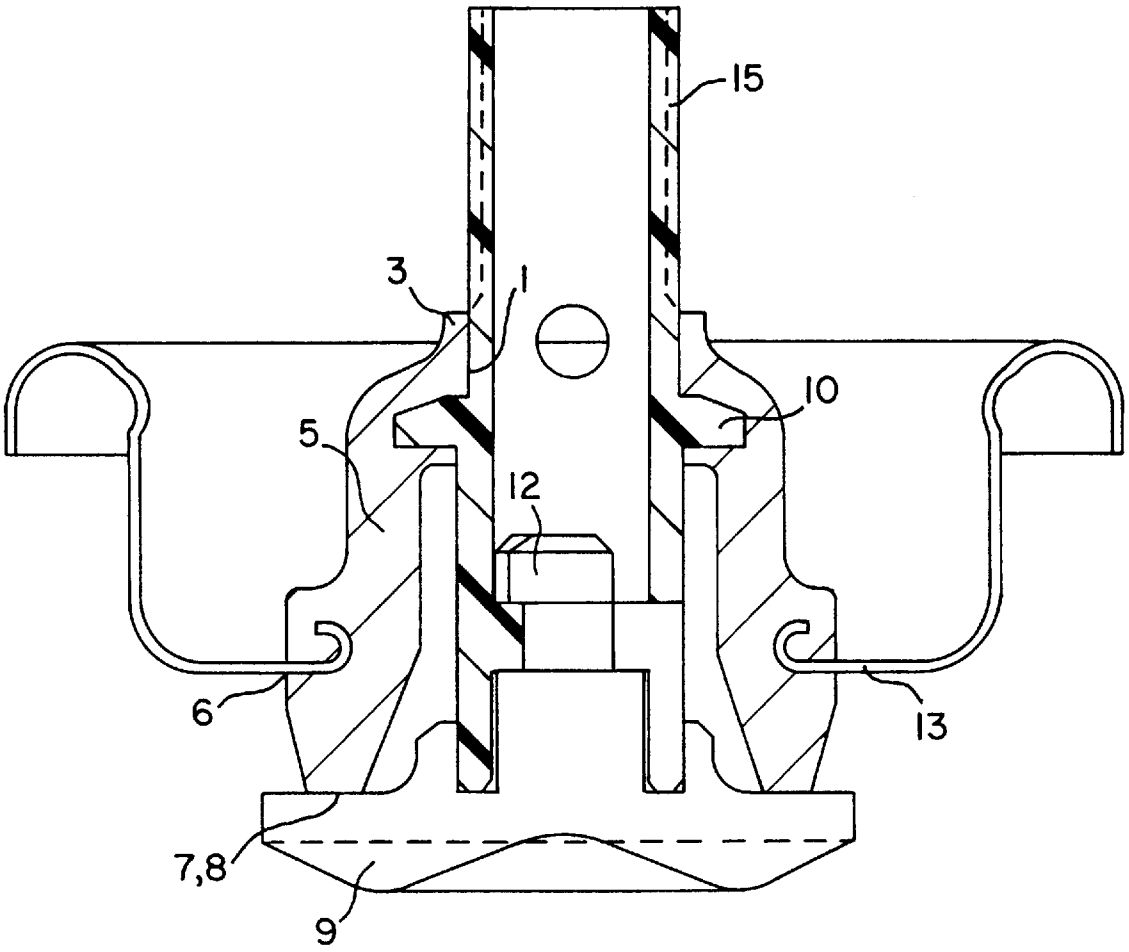
FIG. 5 shows a valve arrangement with a modified valve stem.
Figure 7:
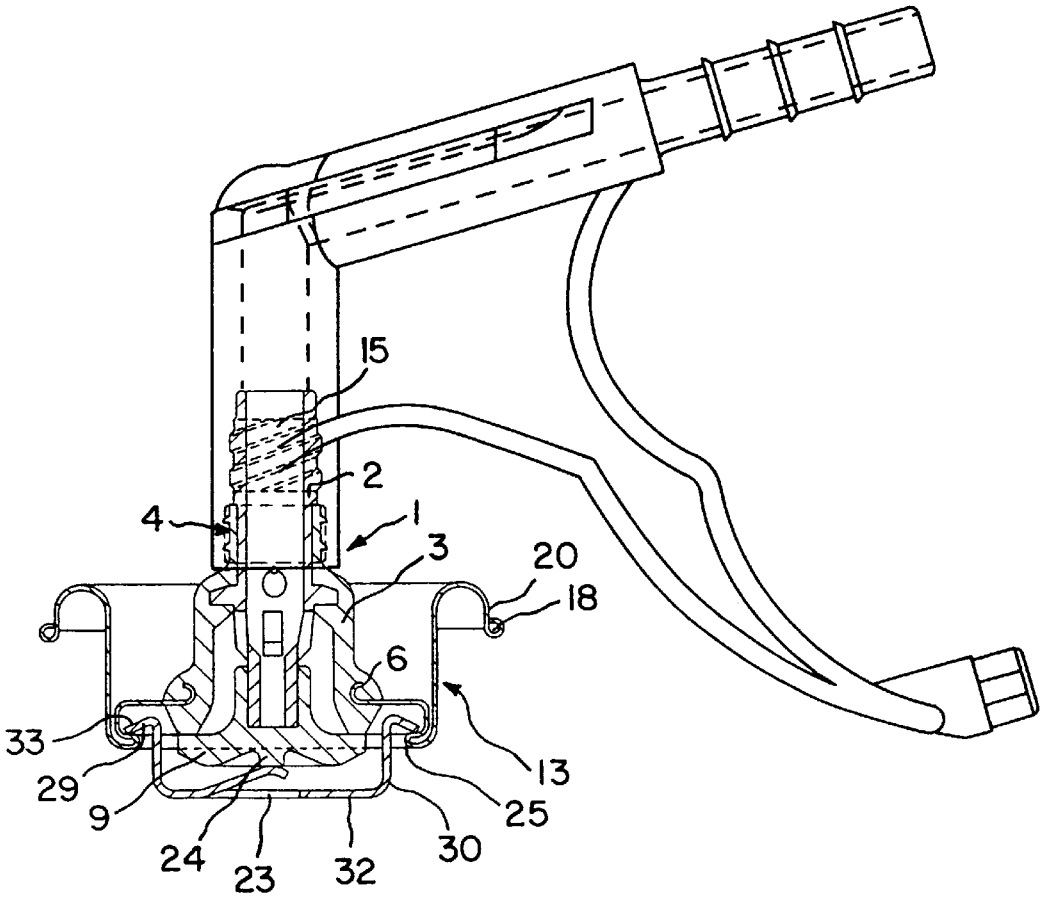
FIG. 7 shows a valve arrangement with a screwed-on discharge handle.
Figure 8:
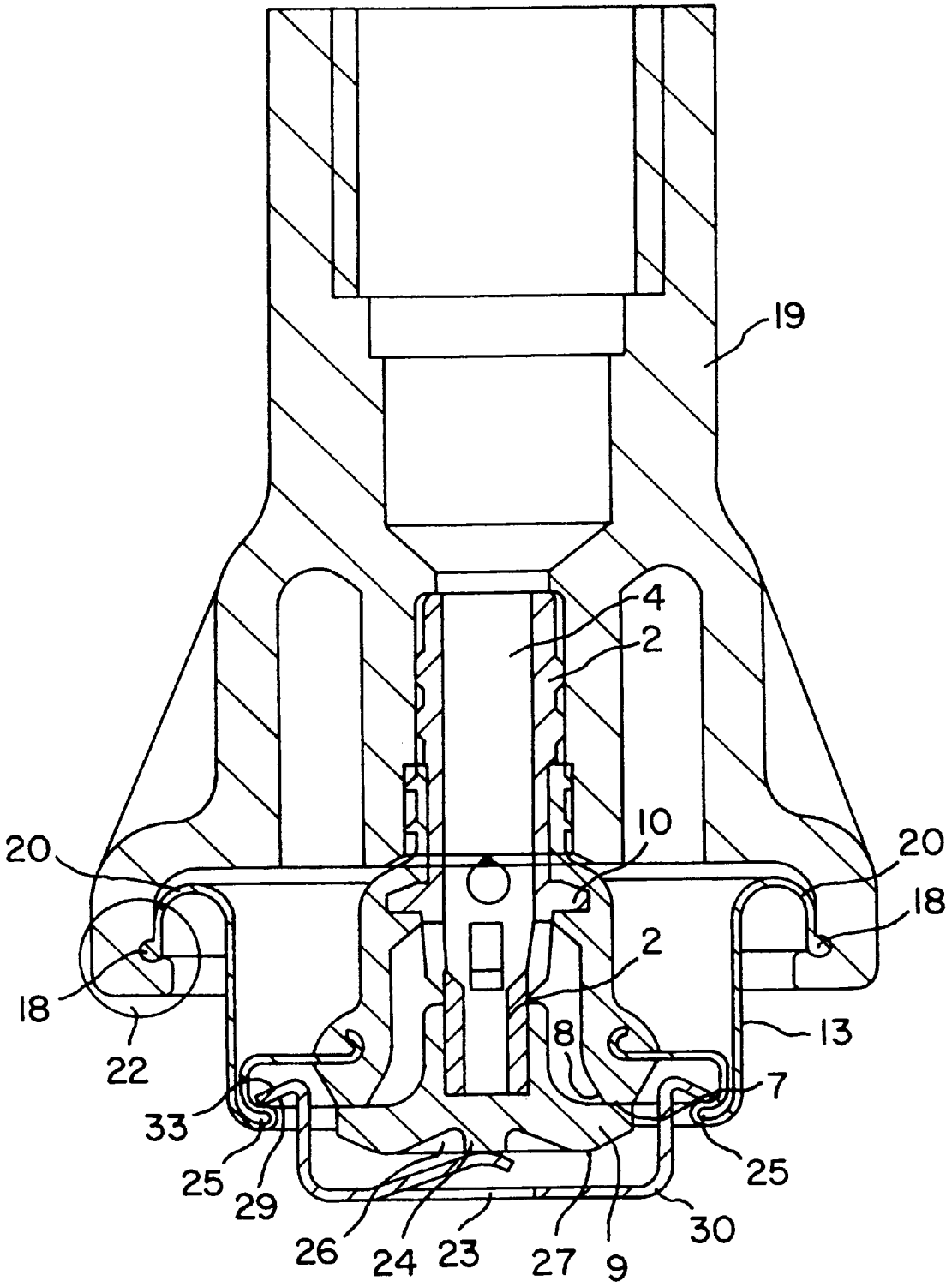
FIG. 8 shows a valve arrangement with a mounted discharge-gun adapter (bayonet fastener)
Figure 9:
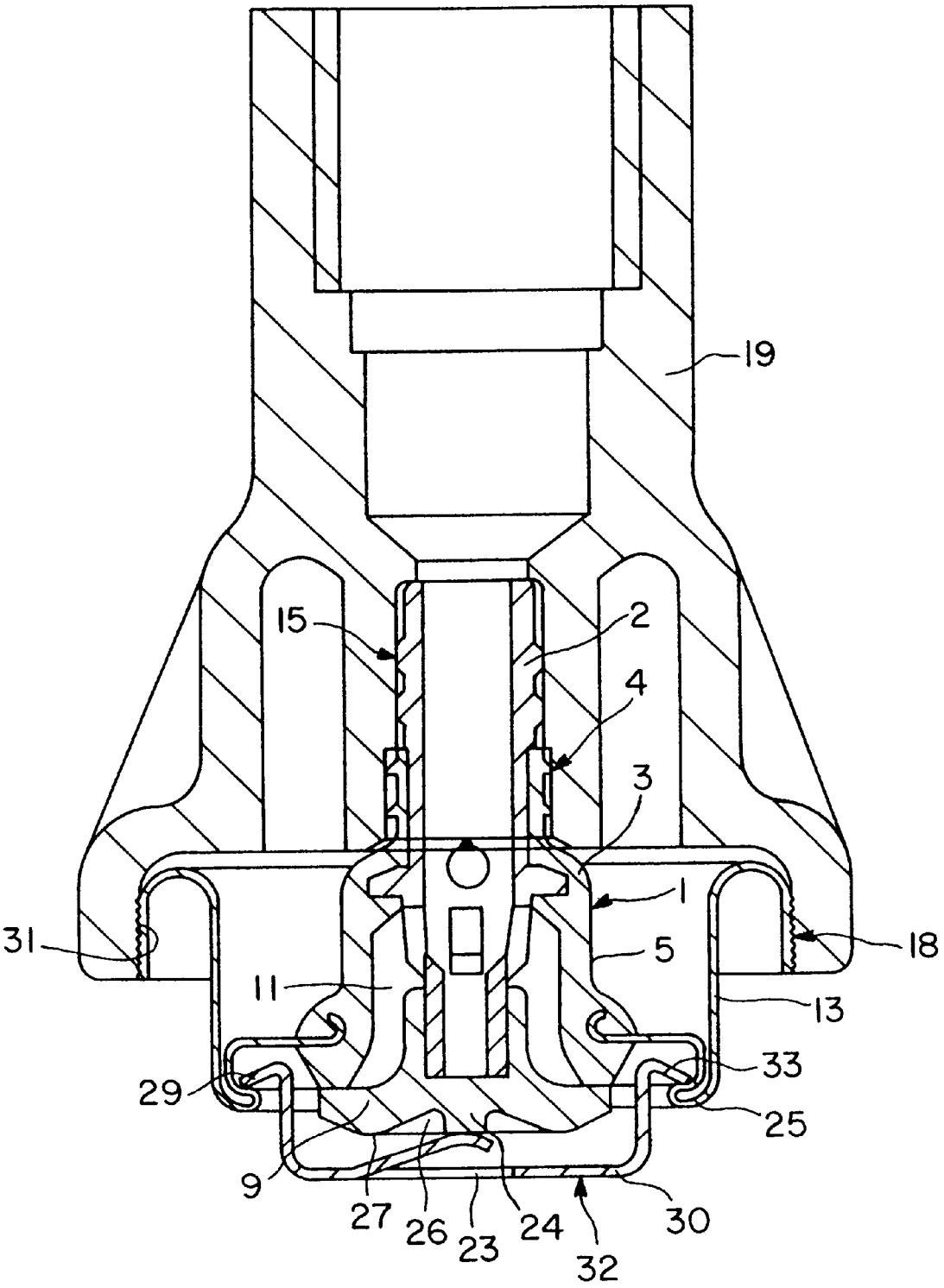
FIG. 9 shows a valve arrangement with a mounted discharge-gun adapter with modified connecting elements (threaded connection).

FIG. 5 shows an embodiment with an external thread 15 on the inner hard part 2 of the valve body 1. A device such as a gun-type adapter, an example of which is also illustrated in FIG. 7, can be screwed onto this external thread.

Figure 6:
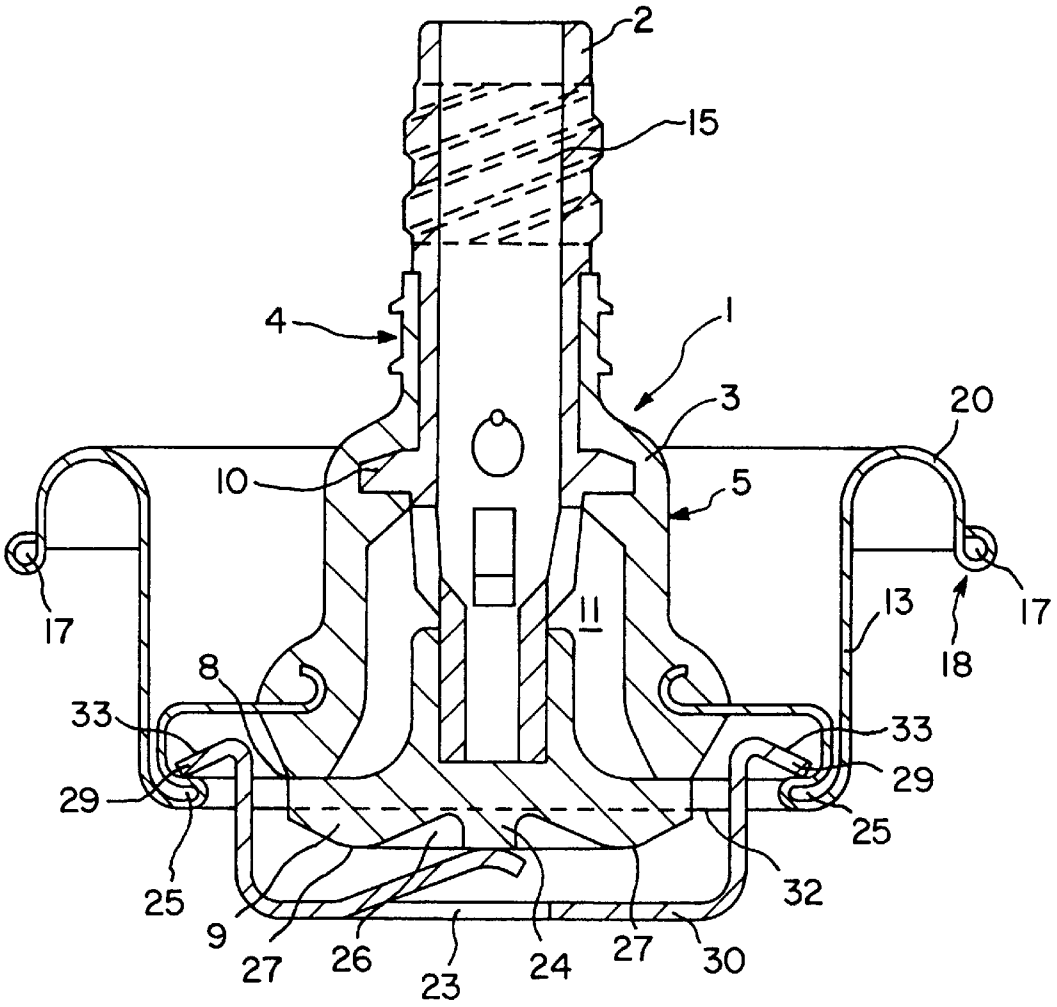
FIG. 6 shows a valve arrangement with a further modified valve stem.

The practical example illustrated in FIG. 6 differs from that according to FIG. 5 in three respects. Firstly the valve disk 13 is provided on the radially outside rim 20 of the disk, which is bent over in the shape of a U, with at least one radially outward projection 18 for fixing a discharge-gun adapter 19. The projection 18 can be formed as a circumferential beading 17 around the rim 20 of the valve disk and can constitute an element of a bayonet fastener 22, which can be locked by turning, between the valve disk 13 and discharge-gun adapter 19.

For this purpose the discharge-gun adapter 19 is provided with latching hooks, which elastically engage over at least one projection 18 or the beading 17 in order to make the connection.

A further difference between the practical examples in FIGS. 5 and 6 is that the valve stem 4 of the upper region of the outer soft part 3 is provided with sealing lips underneath the external thread 15 of the valve stem 4. Thereby the elements disposed on the valve stem 4 perform a double function, namely attachment of a part fixed thereto by screwing it onto the external thread 15, and sealing by the sealing lips, as can be very important, for example, in the case of a mounted discharge-gun adapter 19.

Furthermore, the lower region of the valve disk 13 is modified to the effect that it is drawn in the shape of a pot into the region of the sealing member 9, and is provided in the region of the sealing member 9 with inwardly directed holding projections 25, in which an elastic member 30 bearing on the sealing member 9 in closing direction can be suspended. The elastic member 30 is a metal body stamped in the shape of a pot, in the bottom region 32 of which there is disposed an elastic punched-out tongue 23 directed toward the sealing member 9. The elastic member 30 is provided with radially outside latching hooks 29, which have a sliding inclined face 33 so that they can be pressed into the holding projections 25 of the valve disk 13.

The elastic member 30 bears on the center of the sealing member 9 in a closing direction, and for this purpose the underside 27 of the sealing member 9 has a central projection 24 which cooperates with the elastic member 30. The central projection 24 is surrounded by an approximately annular, circumferential depression 26 facing the elastic member 30.

I claim:

1. A valve arrangement for a container for dispensing pressurized liquid or foam, especially PU foam such as assembly or sealing foam, from a container, the valve arrangement having the following features:

the container is provided at its container top side with a valve disk (13), which has an opening, especially of a circular shape, in which a valve body (1) equipped with a valve stem (4) is fixed, the valve stem (4) is depressible against elastic restoring force, and thus cooperates with sealing elements in the manner of a valve opening, the sealing elements are provided on the sealing member with sealing faces, especially of a planar or conical shape, which faces in closed position bear on sealing faces of the valve body (1) disposed in a plane or conical manner, and the valve body (1) is a plastic sandwich structure consisting of an inner hard part (2) and an outer soft part (3), characterized by the following features:

the inner hard part (2) and the outer soft part (3) are intimately joined together at the common contact surfaces by an injection-molding process to form a perfect bond, whereas the outer soft part (3) is constructed dome-shaped beyond the valve disk (13) forming a space (11) between the inner hard part (2) and the outer soft part (3) and providing a depressible, flexible region for the opening of the valve arrangement.

2. A valve arrangement according to claim 1, characterized in that, the inner hard part (2) is formed as a tubular member, which passes completely or at least partly through the valve stem (4) or forms the valve stem (4).

3. A valve arrangement according to claim 2, characterized by the following features:

the outer soft part (3) forms at its upper end, a valve-stem seal, in the middle, a flexible region (5) for depressing the valve body (1), thereunder, the connecting and sealing region (6) between valve body (1) and valve disk (13) and at its lower end, the sealing face (7) for the valve opening (8).

4. A valve arrangement according to claim 3, characterized in that, the space (11) filled with material to be discharged and disposed between the valve body (1) and a sealing member (9) has small volume.

5. A valve arrangement according to claim 4, characterized in that, the inner hard part (2) of the valve body (1) is provided in its middle region with an outwardly directed annular shoulder (10).

6. A valve arrangement according to claim 5, characterized in that, the sealing member (9) is attached to the bottom open end of the inner hard part (2).

7. A valve arrangement according to claim 6, characterized in that, a holding element (bayonet fastener 12) that engages in the bottom open end of the inner hard part (2) is disposed at the top end of the sealing member (9).

8. A valve arrangement according to claim 6, characterized in that, the joint between the sealing member (9) and the bottom end of the hard part (2) is formed by press-fitting, cementing or ultrasonic bonding.

9. A valve arrangement according to claim 6, characterized in that, the wall thickness of the flexible region (5) is larger than the wall thickness of the tubular member.

10. A valve arrangement according to claim 5, characterized in that, in the case of domed shape of the flexible region (5), the outwardly directed annular shoulder (10) is continued in the manner of a convexly arched dome (10'), which is covered externally by a dome of the outer soft part (3).

11. A valve arrangement according to claim 10, characterized in that, the bottom edge of the dome (10') ends approximately in the region of the valve disk (13).

12. A valve arrangement according to claim 11, characterized in that, the wall thickness of the dome (10') is smaller than the wall thickness of the tubular member (2').

13. A valve arrangement according to claim 12, characterized in that, the lower region of the dome (10') is made in the manner of a cylindrical wall.

14. A valve arrangement according to claim 13, characterized in that, the cylindrical region of the dome (10') is surrounded by a section (21) of the outer soft part (3) having greater material thickness, in which the valve disk (13) is anchored by injection molding.

15. A valve arrangement according to claim 14, characterized in that, the bottom edge of the tubular member (2') protrudes beyond the bottom edge of the dome (10').

16. A valve arrangement according to claim 15, characterized in that, the valve-stem seal is provided with sealing lips.

17. A valve arrangement according to claim 16, characterized in that, the tubular member (2') protrudes beyond the upper region of the outer soft part (3) and forms a hard valve stem provided with an external thread (15).

18. A valve arrangement according to claim 17, characterized in that, the upper region of the outer soft part (3) is provided with sealing lips underneath the external thread (15).

19. A valve arrangement according to claim 18, characterized in that, the valve disk (13) is provided with a threaded part (14) that therein is secured against twisting.

20. A valve arrangement according to claim 19, characterized in that, the valve disk (13) is provided on the radially outside rim (20) of the valve disk, which is bent over in the shape of a U, with at least one radially outward projection (18) for fixing a discharge-gun adapter (19).

21. A valve arrangement according to claim 20, characterized in that, the at least one projection (18) is formed as a circumferential beading (17) around the rim (20) of the valve disk (13).

22. A valve arrangement according to claim 21, characterized in that, the discharge-gun adapter (19) is provided with latching hooks which elastically engage over the at least one projection (18) or the beading (17) in order to make a latching snap connection.

23. A valve arrangement according to claim 20, characterized in that, an element of a bayonet fastener (22), which can be locked by turning, is formed between the valve disk (13) and the discharge-gun adapter (19) by at least one projection (18).

24. A valve arrangement according to claim 20, characterized in that, the at least one projection (18) is formed as an external thread, on which the discharge-gun adapter (19) provided with a matching internal thread (31) can be mounted directly.

25. A valve arrangement according to claim 10, characterized in that, the valve disk (13) is drawn in the shape of a pot into the region of the sealing member (9), and is provided in the region of the sealing member (9) with inwardly directed holding projections (25), in which an elastic member (30) bearing on the sealing member (9) in closing direction can be suspended.

26. A valve arrangement according to claim 25, characterized in that, the elastic member (30) is formed as a metal body stamped in the shape of a pot, in the bottom region (32) of which there is disposed an elastic punched-out tongue (23) directed toward the sealing member (9).

27. A valve arrangement according to one of the preceding claims 25 and 26, characterized in that, the elastic member (30) is provided with radially outside latching hooks (29), which are formed with a sliding inclined face (33) so that they can be pressed into the holding projections (25) of the valve disk (13).

28. A valve arrangement according to claim 27, characterized in that, the elastic member (30) bears on the center of the sealing member (9) in closing direction.

29. A valve arrangement according to claim 28, characterized in that, the underside (27) of the sealing member (9) has a central projection (24), on which the elastic member (30) bears in closing direction.

30. A valve arrangement according to claim 29, characterized in that, the central projection (24) is surrounded by an approximately annular, circumferential depression (26) facing the elastic member (30).

* * * * *

UNITED STATES PATENT AND TRADEMARK OFFICE

CERTIFICATE OF CORRECTION

PATENT NO. : 5,927,563

DATED : July 27, 1999

INVENTOR(S) : Klaus Kellner

It is certified that error appears in the above-identified patent and that said Letters Patent is hereby corrected as shown below:

Col. 2, line 1, delete "f?r" and insert – for –.

Signed and Sealed this

Twenty-eighth Day of November, 2000

*Attest:*

*Attesting Officer*

Q. TODD DICKINSON

*Director of Patents and Trademarks*